United States Patent [19]

Kronogard

[11] 4,172,361

[45] Oct. 30, 1979

[54] GAS TURBINE STATOR STRUCTURE

[76] Inventor: Sven-Olof Kronogard, Karstorpsvagen 31, Lomma, Sweden, 23400

[21] Appl. No.: 834,919

[22] Filed: Sep. 20, 1977

[30] Foreign Application Priority Data

Sep. 24, 1976 [SE] Sweden ..... 7610577

[51] Int. Cl.[2] ..... F02C 3/10

[52] U.S. Cl. ..... 60/39.16 R; 415/161

[58] Field of Search ..... 60/39.16 R, 39.17, 39.16 S; 415/160, 161, 162, 193, 194, 195, 199.5

[56] References Cited

U.S. PATENT DOCUMENTS

| | | | |
|---|---|---|---|
| 3,498,057 | 3/1970 | Kronogard | 60/39.16 S |
| 3,745,629 | 7/1973 | Pask et al. | 415/195 |
| 4,053,256 | 10/1977 | Hertel | 415/160 |

FOREIGN PATENT DOCUMENTS

| | | | |
|---|---|---|---|
| 2158578 | 7/1972 | Fed. Rep. of Germany . | |
| 823441 | 1/1938 | France | 415/194 |
| 2294328 | 9/1976 | France . | |

*Primary Examiner*—Louis J. Casaregola

*Attorney, Agent, or Firm*—Cantor and Singer

[57] ABSTRACT

In an automotive power plant, where the power turbine will repeatedly be stalled while different amounts of gas pass its stationary rotor, detrimental conditions at the outlet stator are avoided by designing the individual guide vanes so the leading edges are inclined in the direction of flow by an amount of 20°–60° with respect to a radial plane normal to the power turbine rotor axis.

The inclination may be selected so it runs substantially straight from the radially inward end of the vane to its tip, or from the radially inward end as well as from the top to provide a notched, or U-shaped profile.

1 Claim, 7 Drawing Figures

GAS TURBINE STATOR STRUCTURE

BACKGROUND OF THE INVENTION

With gas turbines, especially for automotive plants, considerable variations with respect to angular direction, as well as to velocity will occur in the gas flow during various operating conditions. On occasions, supersonic velocities will occur, which imposes considerable loads upon the individual guide vanes in the stator portion, as well as upon the vane grid as a unit, and will involve problems in matching the components, when one flow directing member receives the flow leaving a preceeding member.

With a conventional, automotive gas turbine plant having a separate power turbine rotor, the latter will not, during starting and acceleration of the vehicle, or during idling with a stationary vehicle, transform the gas flowing through the rotor into work. The gas will therefore, especially during stall and full throttle, leave the power turbine rotor vanes with a velocity, considerably higher than that attained during normal operating conditions, and simultaneously with a high degree of rotation and consequent losses. It is therefore necessary to design the leading edge of the individual guide vane in such a manner that the vane, on the one hand, can withstand temperature strains and vibrations, and, on the other hand can take care of the gas flow in an efficient manner.

SUMMARY OF THE INVENTION

The desirable features are, according to the invention, obtainable by designing the leading edge of an individual guide vane forming part of a stator structure downstream of the power turbine rotor so it is inclined in the direction of the gas flowing into the rotor structure by an amount of 20°-60° with respect to a radial plane being normal to the power turbine rotor axis.

The leading edge may be designed so it is inclined in the direction of the flow of the gases from the radially inward part of the vane, all the way to the outward part of the vane, but may also be shaped so it forms a V or a U, i.e. being inclined in the direction of flow of the gases from the radially inward part, as well as from the outward part. The guide vanes may, as viewed in a transverse section be inclined with respect to axial planes including the rotor axis and may futhermore be designed with a profile being arcuate with respect to axial planes including the rotor axis.

DESCRIPTION OF SOME PREFERRED EMBODIMENTS

Figure 1:
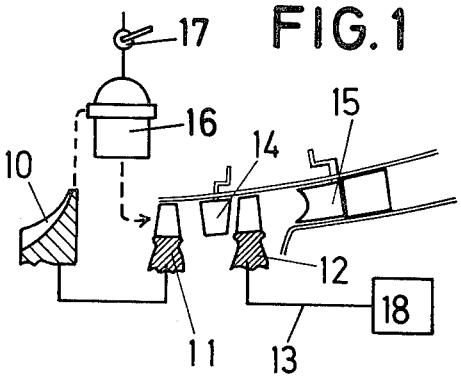
FIG. 1 schematically shows a gas turbine plant having a gazifier portion and a separate power turbine.

FIG. 1 very schematically shows a gas turbine plant adapted for automotive purposes, and comprising a compressor 10, a first turbine rotor 11 driving the same, and a second turbine rotor 12, which is connected to a power take-off shaft 13. The gazifier portion further includes a combustor 16 and fuel supply means including a throttle device 17.

The output shaft 13 is connected to a transmission, generally denoted by 18, which transfers the torque from shaft 13 to the driven wheels of the vehicle. The flow of gas through the turbine is determined by means of thottle 17, but on occasions the vehicle will be braked, or brought to a standstill, which means that the speed of the power turbine rotor will be affected in a corresponding manner.

It should however expressly be pointed out, that the turbine plant may contain more rotors than those shown, and that these rotors may be interconnected in a well-known manner by transmission members permitting the transfer of power between the rotors. Such power transferring transmissions will have to be designed in such a manner that the gazifier portion can rotate independently of the power turbine rotor.

Adjustable guide vanes 14 of conventional design are fitted between compressor turbine rotor 11 and power turbine rotor 12, and downstream of the power turbine rotor there is a stator structure 15, the vanes of which will be described in connection with FIG. 4. When the power turbine rotor is the last turbine stage, it is important to take care of the high velocity of the exhaust gases during low speed and stall, and to transfer the velocity into pressure in an optimal manner, which has not been possible with designs of hitherto known kind. The invention will open new possibilities of increasing the outlet velocity and the starting torque with a stalled turbine rotor.

Figure 2:
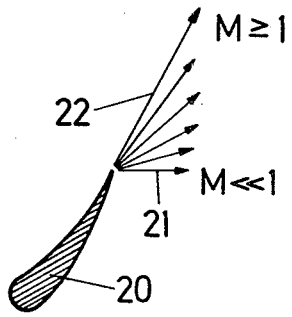
FIG. 2 illustrates changes in the velocity and in the direction of gas flow, downstream of a rotor vane in the power turbine.

FIG. 2 illustrates changes in relative velocity and direction of the gas leaving a vane 20 in the power turbine rotor 12. Arrow 21 indicates the conditions at full operating speed, i.e. the flow direction is substantially axial and the velocity is less than Mach 1, $M << 1$. When power turbine rotor 12 is stalled the direction of outlet flow 22 will be determined by the stationary vane 20, and the velocity is noticeably increased, sometimes to a Mach number bigger than 1, compared to the velocity at ordianry operating speed. Between these two border limits, there will be a plurality of flow conditions, depending upon how the rotor is retarded, and the simultaneous gas flow from the gazifier portion. These high outlet velocities will impose severe strains upon the guide vanes, thermally as well as mechanically due to impact shocks.

A vane of a rotor, or of a stator is often twisted from its root to its tip, which means that such a vane, in a schematic drawing will show a slightly increased leading edge. This may also be a result of tapering due to a desire to reduce the cross section of a rotor vane towards the tip, where the centrifugal action is most pronounced.

Such inclination of the leading edge is generally in the order of 2°-6°, and will have no influence upon the possibilities of the vane in meeting and transforming the onflowing gas.

Figure 3:
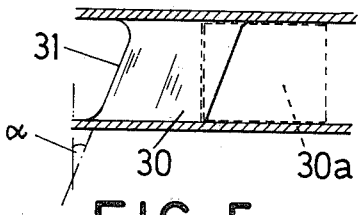
FIGS. 3 and 4 show two types of guide vanes.

As is evident from FIG. 3 the guide vane 30 may be shaped so its leading edge 31 is inclined (angle $\alpha$) in the direction of flow of the gases, from the radially inward part to its outward part. The inclined leading edge runs substantially straight all along the vane. The degree of inclination may be selected from 20° to 60°, i.e. considerably more than what is found in conventional guide vanes.

Figure 4:
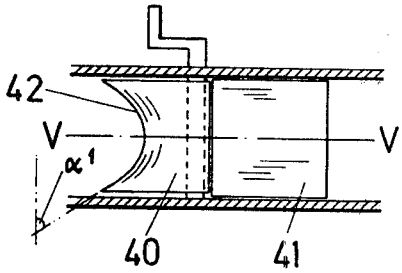

According to FIG. 4, which corresponds to the guide vane 15 of FIG. 1, the individual guide vane includes a nose portion 40, which is angularly adjustable, and a stationary tail portion 41. The leading edge 42 of the guide vane is here designed in such a manner that it is inclined in the direction of gas flow from the radially inward part, as well as from the outward part. This arrangement makes possible big angles of inclination, while maintaining the strength of the vane, resulting in a high reduction of flow losses, even during considerable angular variations in the direction of gas flow.

The embodiment according to FIG. 3 shows, in dotted lines, a modification including two stationary vane parts (30, 30*a*). It is evident that also here the nose part may be adjustable, in the same manner as part 40 of FIG. 4.

Guide vane part 40 of FIG. 4 may be extended in the direction of flow, thus obviating the use of stationary tail portion.

If a third turbine rotor is fitted downstream of any of the guide vane stators, above referred to, it is possible to design the tail portion 30*a* or 41, respectively, to be angularly adjustable, while having a stationary nose portion provided with a U- or V-shaped leading edge, being less sensitive to Mach-impacts.

By arranging the guide vanes so they, when viewed in a transverse section, are inclined with respect to axial plane including the rotor axis, it is possible further to influence the gas flow, and to reduce the sensitivity to high Mach-numbers and angular variations at the stator inlet.

Figure 5:
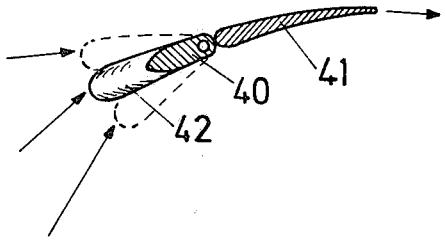
FIG. 5 shows a section along line V—V in FIG. 4, and FIGS. 6 and 7 show portions of stator grids, as viewed in transverse sections.

FIG. 5 shows a section along line V—V in FIG. 4. The leading edge of nose portion 40 is inclined from the radially inward part of the vane, as well as from its outward part, and will permit a bigger angle of inclination, $\alpha 1$, than with the embodiment according to FIG. 3, where the leading edge is inclined an angle $\alpha$ all the way from the radially inward part of the vane to its outward part.

Figure 6:
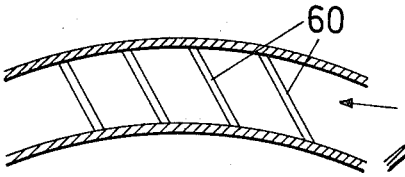

With the embodiment according to FIG. 6 the guide vanes 60 are further inclined in the direction of flow of the gases with respect to axial planes including the rotor axis, which means that the gas flow will be forced outwardly. This arrangement is especially useful, when the gas flow has to pass along an outwardly curved path, within or downstream of the stator, as the stator will direct the flow outwardly in the curved path.

Figure 7:
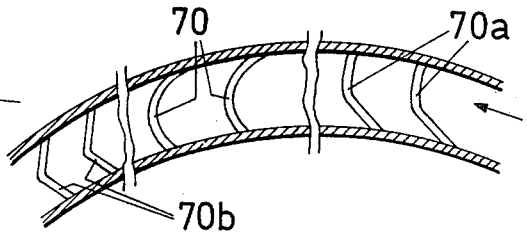

With the embodiment according to FIG. 7 the individual guide vanes 70, 70*a* and 70*b*, respectively, are each curved in relation to a longitudinal middle plane including the vane and the rotor axis, whereby the gas flow will have less tendency to break away, as the design will reduce the sensitivity to Mach-number and angle of entrance, and increase the capacity for deflection, by an increased transverse exchange of boundary layers, especially for low height-breadth ratios (aspect ratios) for the vane grid.

The drawing does only show a few embodiments, and it is evident, that the stator grids may be designed and fitted into the turbine in many different ways within the scope of the appended claims.

For stationary turbine grids according to FIGS. 6 and 7, having vanes with an inclined leading edge, a high degree of flexibility and capacity of withstanding thermal strains is obtained, as well as a possibility of providing an efficient air cooling of the stationary vane part, from the inward and/or from the outward mounting ring. The guide vanes may be manufactured from ceramic material, wholly or in part.

What I claim is:

1. An automotive gas turbine plant comprising at least one power turbine rotor and a gazifier portion operable independently thereof, a stator structure comprising a number of guide vanes downstream of said at least one turbine rotor, means for mounting said vanes in a substantially radial position, each of said guide vanes having a leading edge being inclined in the direction of flow of gases by an amount of 20°–60° with respect to a radial plane being normal to the power turbine rotor axis, and wherein, the leading edge of each guide vane is inclined from the radially inward part of the vane, as well as from the outward part of the vane to provide a substantially concave profile at the leading edge.

* * * * *